US011114227B2

(12) United States Patent
Uesaka et al.

(10) Patent No.: US 11,114,227 B2
(45) Date of Patent: Sep. 7, 2021

(54) NON-ORIENTED ELECTRICAL STEEL SHEET AND METHOD FOR MANUFACTURING NON-ORIENTED ELECTRICAL STEEL SHEET

(71) Applicant: JFE STEEL CORPORATION, Tokyo (JP)

(72) Inventors: Masanori Uesaka, Tokyo (JP); Kunihiro Senda, Tokyo (JP); Takeshi Omura, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 521 days.

(21) Appl. No.: 16/065,352

(22) PCT Filed: Dec. 14, 2016

(86) PCT No.: PCT/JP2016/087279
§ 371 (c)(1),
(2) Date: Jun. 22, 2018

(87) PCT Pub. No.: WO2017/115657
PCT Pub. Date: Jul. 6, 2017

(65) Prior Publication Data

US 2019/0189318 A1 Jun. 20, 2019

(30) Foreign Application Priority Data

Dec. 28, 2015 (JP) ..... JP2015-256634

(51) Int. Cl.
*H01F 1/16* (2006.01)
*C21D 8/12* (2006.01)
(Continued)

(52) U.S. Cl.
CPC ..... *H01F 1/16* (2013.01); *C21D 1/76* (2013.01); *C21D 8/1222* (2013.01);
(Continued)

(58) Field of Classification Search
None
See application file for complete search history.

(56) References Cited

U.S. PATENT DOCUMENTS 9,767,946 B2 9/2017 Zaizen et al.
9,805,851 B2 10/2017 Watanabe et al.
(Continued)

FOREIGN PATENT DOCUMENTS

CN 104662180 A 5/2015
EP 2826872 A1 1/2015
(Continued)

OTHER PUBLICATIONS

Sep. 11, 2018, the Extended European Search Report issued by the European Patent Office in the corresponding European Patent Application No. 16881636.1.
(Continued)

*Primary Examiner* — Paul A Wartalowicz
*Assistant Examiner* — Stephani Hill
(74) *Attorney, Agent, or Firm* — Kenja IP Law PC

(57) ABSTRACT

A non-oriented electrical steel sheet has low iron loss even under inverter excitation and can be suitably used as the iron core of a motor. The non-oriented electrical steel sheet has a specific chemical composition and an average grain size r of 40 μm to 120 μm. An area ratio R of a total area of grains having a grain size of ⅙ or less of the thickness of the steel sheet to a cross-sectional area of the steel sheet is 2% or greater, and the average grain size r (μm) and the area ratio R (%) satisfy a condition represented by Expression (1), $R>-2.4\times r+200$ (1).

12 Claims, 4 Drawing Sheets

(51) Int. Cl.

| | |
|---|---|
| ***C22C 38/02*** | (2006.01) |
| ***C22C 38/04*** | (2006.01) |
| ***C22C 38/00*** | (2006.01) |
| ***C22C 38/14*** | (2006.01) |
| ***C22C 38/60*** | (2006.01) |
| ***C22C 38/06*** | (2006.01) |
| ***H01F 1/147*** | (2006.01) |
| ***C21D 9/46*** | (2006.01) |
| ***C21D 1/76*** | (2006.01) |

(52) U.S. Cl.

CPC ..... *C21D 8/1233* (2013.01); *C21D 8/1261* (2013.01); *C21D 8/1266* (2013.01); *C21D 8/1272* (2013.01); *C21D 9/46* (2013.01); *C22C 38/00* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/14* (2013.01); *C22C 38/60* (2013.01); *H01F 1/14775* (2013.01)

(56) References Cited

U.S. PATENT DOCUMENTS

| | | | | |
|---|---|---|---|---|
| 9,920,393 | B2 | 3/2018 | Zaizen et al. | |
| 2006/0185767 | A1* | 8/2006 | Arita | H01F 1/14775 148/111 |
| 2012/0321502 | A1 | 12/2012 | Shimazu et al. | |
| 2013/0263981 | A1* | 10/2013 | Zaizen | C22C 38/04 148/645 |
| 2015/0059929 | A1* | 3/2015 | Zaizen | C21D 6/005 148/111 |
| 2015/0187475 | A1* | 7/2015 | Zaizen | C22C 38/04 148/309 |
| 2015/0243419 | A1 | 8/2015 | Senda et al. | |
| 2015/0348686 | A1* | 12/2015 | Toda | C21D 8/1261 148/111 |

FOREIGN PATENT DOCUMENTS

| | | | | |
|---|---|---|---|---|
| EP | 2889389 | A1 | 7/2015 | |
| GN | 103890211 | A | 6/2014 | |
| JP | H1025554 | A | 1/1998 | |
| JP | 2001049340 | A | 2/2001 | |
| JP | 2001279403 | A | 10/2001 | |
| JP | 2002294414 | A | 10/2002 | |
| JP | 2002294417 | A | 10/2002 | |
| JP | 2007247047 | A | 9/2007 | |
| JP | 4860783 | B2 | 1/2012 | |
| JP | 2013044012 | A | 3/2013 | |
| KR | 1020140113739 | A | 9/2014 | |
| KR | 1020150023770 | A | 3/2015 | |
| TW | 200403346 | A | 3/2004 | |
| WO | WO-2012086534 | A1 * | 6/2012 | C21D 8/1272 |
| WO | WO-2013137092 | A1 * | 9/2013 | C21D 6/008 |
| WO | WO-2014030512 | A1 * | 2/2014 | C22C 38/002 |
| WO | WO-2014129106 | A1 * | 8/2014 | C21D 8/1261 |

OTHER PUBLICATIONS

Jul. 18, 2019, Office Action issued by the Korean Intellectual Property Office in the corresponding Korean Patent Application No. 10-2018-7018262 with English language concise statement of relevance.

Mar. 6, 2020, Office Action issued by the China National Intellectual Property Administration in the corresponding Chinese Patent Application No. 201680076599.4 with English language search report.

Jul. 20, 2017, Office Action issued by the Taiwan Intellectual Property Office in the corresponding Taiwanese Patent Application No. 105142630 with English language Search Report.

Mar. 21, 2017, International Search Report issued in the International Patent Application No. PCT/JP2016/087279.

* cited by examiner

NON-ORIENTED ELECTRICAL STEEL SHEET AND METHOD FOR MANUFACTURING NON-ORIENTED ELECTRICAL STEEL SHEET

TECHNICAL FIELD

The present disclosure relates to a non-oriented electrical steel sheet with an extremely small increase in iron loss due to harmonics generated by switching of the inverter when the steel sheet is used as the iron core of a motor. The present disclosure also relates to a method for manufacturing the non-oriented electrical steel sheet with the aforementioned characteristics.

BACKGROUND

Electrical steel sheets have been widely used as iron core material in motors, transformers, and the like. In recent years, energy reduction has become a focus in various fields to address environmental issues and reduce costs, and strong demands have been made for reduced iron loss in electrical steel sheets.

Motors have conventionally been driven by a sinusoidal alternating current. For increased efficiency in the field of motors, it is now becoming common to drive motors by pulse width modulation (PWM) control using an inverter. In PWM control using an inverter, however, it is known that harmonics caused by switching of the inverter are superimposed, leading to an increase in energy consumption in the iron core. For this reason, materials are developed taking into consideration the magnetic properties, under inverter excitation, of non-oriented electrical steel sheets for motors.

For example, JP H10-025554 A (PTL 1) discloses controlling the sheet thickness of the non-oriented electrical steel sheet to be 0.3 mm to 0.6 mm, the sheet surface roughness Ra to be 0.6 μm or less, the specific resistance to be 40 μΩ·cm to 75 μΩ·cm, and the grain size to be 40 μm to 120 μm to improve the efficiency when using the steel sheet as an inverter control compressor motor.

JP 2001-279403 A (PTL 2) discloses a non-oriented electrical steel sheet containing 1.5 mass % to 20 mass % of Cr and 2.5 mass % to 10 mass % of Si and having a sheet thickness of 0.01 mm to 0.5 mm. By adding Cr, the technique disclosed in PTL 2 prevents the steel sheet from becoming brittle due to the presence of a large amount of Si, thereby allowing manufacturing of a non-oriented electrical steel sheet suitable for use under high-frequency excitation.

JP 2002-294417 A (PTL 3) and JP 4860783 B2 (PTL 4) respectively disclose a non-oriented electrical steel sheet including a predetermined amount of Mo and a non-oriented electrical steel sheet including a predetermined amount of W. By adding appropriate amounts of Mo and W, the techniques disclosed in PTL 3 and 4 can suppress the degradation of iron loss due to precipitation of Cr compounds, even when Cr is present.

CITATION LIST

Patent Literature

PTL 1: JP H10-025554 A
PTL 2: JP 2001-279403 A
PTL 3: JP 2002-294417 A
PTL 4: JP 4860783 B2

SUMMARY

Technical Problem

Unfortunately, in the technique disclosed in PTL 1, the steel sheet becomes brittle as a result of adding a large amount of elements such as Si to increase the specific resistance. Furthermore, the sheet thickness needs to be reduced to achieve lower iron loss, but reducing the sheet thickness increases the risk of fracture during manufacturing and of cracks when processing the motor iron core.

The technique disclosed in PTL 2 can suppress an increase in brittleness due to Si but has the problem of increased iron loss due to precipitation of Cr compounds.

The techniques disclosed in PTL 3 and 4 can suppress precipitation of Cr compounds by adding Mo and W but have the problem of an increased alloy cost.

In addition to the above points, known techniques such as those disclosed in PTL 1 to 4 have the problems of greatly deteriorated magnetic properties due to harmonics when using an inverter and of significant deterioration of motor efficiency depending on the excitation conditions.

In light of the above considerations, it would be helpful to provide a non-oriented electrical steel sheet that has low iron loss even under inverter excitation and that can be suitably used as the iron core of a motor. It would also be helpful to provide a method for manufacturing the non-oriented electrical steel sheet with the aforementioned characteristics.

Solution to Problem

As a result of conducting research to solve the aforementioned issues, we discovered that appropriately controlling the grain size of a non-oriented electrical steel sheet allows a reduction in iron loss under inverter excitation.

One example of experiments performed to obtain this finding is described below.

In a laboratory, steel was melted and cast to obtain steel raw material, the steel comprising a chemical composition containing (consisting of), in mass %:

C: 0.0013%,
Si: 3.0%,
Mn: 1.4%,
Sol.Al: 1.5%,
P: 0.2%,
Ti: 0.0006%,
S: 0.001%, and
As: 0.0006%, and the balance consisting of Fe and inevitable impurities. The steel raw material was then subjected sequentially to the following treatments (1) to (5) to produce non-oriented electrical steel sheets.

(1) Hot rolling to a sheet thickness of 2.0 mm,
(2) Hot band annealing consisting of (2-1) and (2-2) below:
(2-1) A first soaking treatment with a soaking temperature of 1000° C. and a soaking time of 200 s,
(2-2) A second soaking treatment with a soaking temperature of 1150° C. and a soaking time of 3 s,
(3) Pickling,
(4) Cold rolling to a sheet thickness of 0.35 mm, and
(5) Final annealing.

The final annealing was performed at various temperatures from 600° C. to 1100° C. to produce a plurality of non-oriented electrical steel sheets with various average grain sizes. The heating during the final annealing was performed under two conditions: condition A of the heating rate being 10° C./s and condition B of the heating rate being 200° C./s. The non-oriented electrical steel sheets obtained under condition A are referred to below as group A, and the non-oriented electrical steel sheets obtained under condition B as group B. The atmosphere during the final annealing was $H_2$:$N_2$=2:8, and the cloud point was −20° C. ($P_{H2O}/P_{H2}$=0.006).

Using the resulting non-oriented electrical steel sheets (final annealed sheets), ring test pieces for evaluating magnetic properties were produced by the following procedure. First, the non-oriented electrical steel sheets were processed by wire cutting into ring shapes with an outer diameter of 110 mm and an inner diameter of 90 mm. Twenty of the cut non-oriented electrical steel sheets were stacked, and a primary winding with 120 turns and a secondary winding with 100 turns were wound around the stack, yielding a ring test piece.

Next, the magnetic properties of the ring test piece were evaluated under two conditions: sinusoidal excitation and inverter excitation. The excitation conditions were a maximum magnetic flux density of 1.5 T, a fundamental frequency of 50 Hz, a carrier frequency of 1 kHz, and a modulation factor of 0.4.

FIG. 1 illustrates the magnetic properties under sinusoidal excitation, and FIG. 2 illustrates the magnetic properties under inverter excitation. FIG. 3 illustrates the relationship between the rate of increase in iron loss $W_{inc}$ and the average grain size. Here, the rate of increase in iron loss refers to the difference between iron loss under inverter excitation and iron loss under sinusoidal excitation expressed as a ratio relative to iron loss under sinusoidal excitation. A detailed definition is provided below.

As can be seen in FIG. 1 through FIG. 3, iron loss decreased along with increased grain size in the non-oriented electrical steel sheets of both groups A and B under sinusoidal excitation. On the other hand, iron loss was greater under inverter excitation than under sinusoidal excitation. In a region where the average grain size was small, iron loss decreased along with an increase in grain size, as with the results under sinusoidal excitation. In a region where the average grain size was at least a certain value, however, the iron loss increased along with an increase in average grain size. Under sinusoidal excitation, the non-oriented electrical steel sheets in group B had iron loss equivalent to that of the non-oriented electrical steel sheets in group A, but under inverter excitation, the non-oriented electrical steel sheets in group B exhibited lower iron loss than the non-oriented electrical steel sheets in group A.

The average grain size of the non-oriented electrical steel sheets in group B tended to be smaller than that of the non-oriented electrical steel sheets in group A obtained at the same annealing temperature. Furthermore, examining the distribution of grain size revealed that many grains having a grain size of 60 μm or less were present even when coarse grains and fine grains were both present in the non-oriented electrical steel sheets of group B, e.g. when the average grain size was approximately 100 μm.

The detailed mechanism by which the iron loss, under inverter excitation, of the non-oriented electrical steel sheets of group B is lower than that of the non-oriented electrical steel sheets of group A is not currently understood. Further investigation into the relationship between the distribution of grain size and the iron loss under inverter excitation, however, indicated that the presence of many fine grains having a grain size of ⅙ or less of the thickness of the steel sheet reduces the maximum value of the primary current under inverter excitation, thereby lowering the iron loss. We thus concluded that the iron loss under inverter excitation can be reduced by controlling the grain size to be within an appropriate range.

The present disclosure is based on the aforementioned discoveries, and the primary features thereof are as follows.

1. A non-oriented electrical steel sheet comprising:

a chemical composition containing (consisting of), in mass %,

C: 0.005% or less,

Si: 4.5% or less,

Mn: 0.02% to 2.0%,

Sol.Al: 2.0% or less,

P: 0.2% or less,

Ti: 0.007% or less,

S: 0.005% or less, one or both of As and Pb: total of 0.0005% to 0.005%, and the balance consisting of Fe and inevitable impurities;

wherein an average grain size r is 40 μm to 120 μm, and wherein an area ratio R of a total area of grains having a grain size of ⅙ or less of a thickness of the steel sheet to a cross-sectional area of the steel sheet is 2% or greater, and the average grain size r μm and the area ratio R % satisfy a condition represented by Expression (1), $$R>-2.4\times r+200 \quad (1).$$

2. The non-oriented electrical steel sheet of 1., wherein the chemical composition further contains, in mass %, one or both of Sn: 0.01% to 0.2% and Sb: 0.01% to 0.2%.

3. The non-oriented electrical steel sheet of 1. or 2., wherein the chemical composition further contains, in mass %, one or more of REM: 0.0005% to 0.005%, Mg: 0.0005% to 0.005%, and Ca: 0.0005% to 0.005%.

4. The non-oriented electrical steel sheet of any one of 1. to 3., wherein the thickness of the steel sheet is 0.35 mm or less.

5. The non-oriented electrical steel sheet of any one of 1. to 4., wherein a rate of increase in iron loss $W_{inc}$ % calculated as $100(W_{inc}-W_{sin})/W_{sin}$ is 100% or less, where using a ring test piece having a magnetic path cross-sectional area of 70 $mm^2$ and having wound thereon a wiring with a primary winding number of 120 turns and a secondary winding number of 100 turns, iron loss $W_{inv}$ is measured when performing excitation by pulse width modulation control using an inverter at a maximum magnetic flux density of 1.5 T, a fundamental frequency of 50 Hz, a carrier frequency of 1 kHz, and a modulation factor of 0.4, and iron loss $W_{sin}$ is measured when performing excitation at a maximum magnetic flux density of 1.5 T and with sinusoidal alternating current at a frequency of 50 Hz.

6. A method for manufacturing a non-oriented electrical steel sheet, the method comprising:

preparing a steel slab comprising a chemical composition containing (consisting of), in mass %, C: 0.005% or less, Si: 4.5% or less, Mn: 0.02% to 2.0%, Sol.Al: 2.0% or less, P: 0.2% or less, Ti: 0.007% or less, S: 0.005% or less, one or both of As and Pb: total of 0.0005% to 0.005%, and the balance consisting of Fe and inevitable impurities;

hot rolling the steel slab into a hot rolled sheet;

subjecting the hot rolled sheet to hot band annealing comprising a first soaking treatment performed with a soaking temperature of 800° C. to 1100° C. and a soaking time of 5 min or less and a second soaking treatment performed with a soaking temperature of 1150° C. to 1200° C. and a soaking time of 5 s or less;

subjecting the hot rolled sheet after the hot band annealing to cold rolling once or cold rolling twice or more with intermediate annealing in between to obtain a steel sheet with a final sheet thickness; and subjecting the steel sheet after the cold rolling to final annealing;

wherein a heating rate from 400° C. to 740° C. during the final annealing is 30° C./s to 300° C./s.

7. The method for manufacturing a non-oriented electrical steel sheet of 6., wherein the chemical composition further contains, in mass %, one or both of Sn: 0.01% to 0.2% and Sb: 0.01% to 0.2%.

8. The method for manufacturing a non-oriented electrical steel sheet of 6. or 7., wherein the chemical composition further contains, in mass %, one or more of REM: 0.0005% to 0.005%, Mg: 0.0005% to 0.005%, and Ca: 0.0005% to 0.005%.

Advantageous Effect

The present disclosure can provide a non-oriented electrical steel sheet that has low iron loss even under inverter excitation and can be suitably used as the iron core of a motor.

DETAILED DESCRIPTION

[Chemical Composition]

Figure 1:
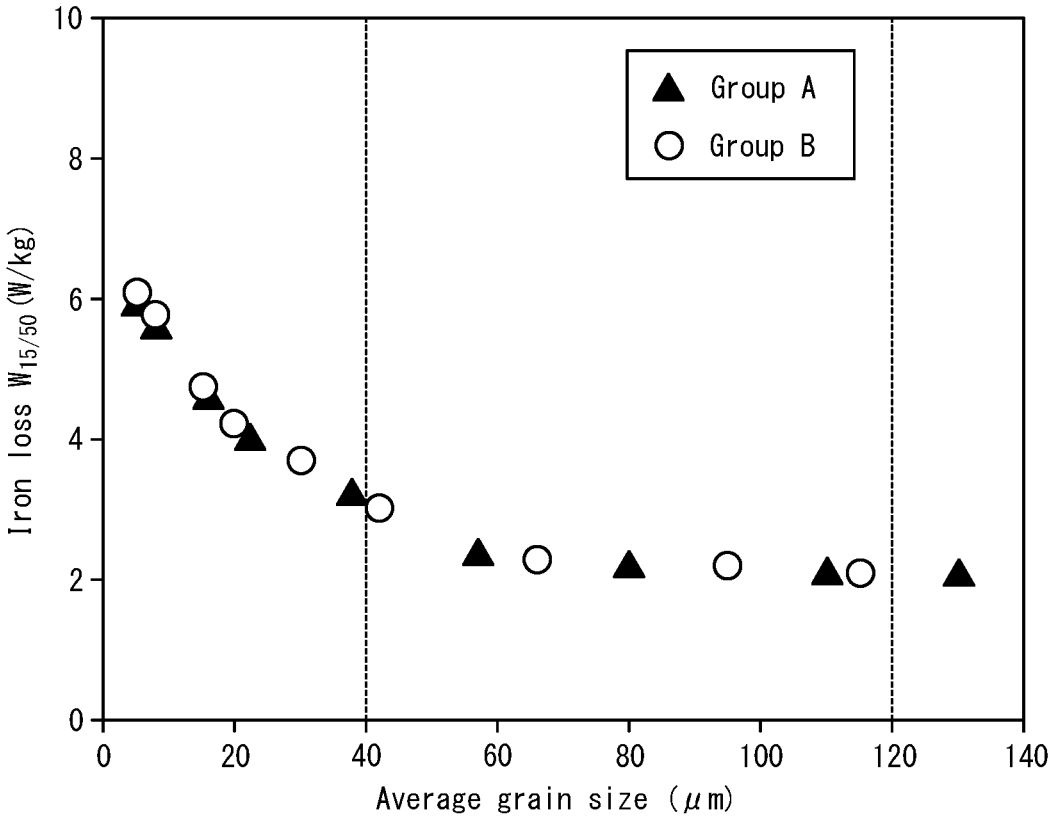
FIG. 1 illustrates the relationship between iron loss under sinusoidal excitation and average grain size.

In the present disclosure, it is important that a non-oriented electrical steel sheet and a steel slab used to manufacture the steel sheet have the aforementioned chemical composition. First, the reasons for limiting the chemical composition will be explained. In the following description, "%" regarding components denotes "mass %" unless otherwise noted.

C: 0.005% or less

If the C content exceeds 0.005%, the iron loss degrades because of magnetic aging. The C content is therefore set to 0.005% or less. The C content is preferably 0.0020% or less and is more preferably 0.0015% or less. No lower limit is particularly placed on the C content, but the C content is preferably 0.0005% or more, since excessive reduction leads to increased refining costs.

Si: 4.5% or less

Si is an element that has the effects of increasing the electrical resistivity of steel and reducing the iron loss. Since the ratio of eddy current loss is higher under inverter excitation than under sinusoidal excitation, it is considered effective to set the electrical resistivity higher than in material used under sinusoidal excitation. If the Si content exceeds 4.5%, however, the sheet becomes brittle and tends to fracture during cold rolling. The Si content is therefore set to 4.5% or less. The Si content is preferably 4.0% or less and is more preferably 3.7% or less. No lower limit is particularly placed on the Si content, but to increase the effect of adding Si, the Si content is preferably 2.5% or more and more preferably 3.0% or more.

Mn: 0.02% to 2.0%

Mn is an element that has the effect of reducing the hot shortness of the steel by bonding with S.

Increasing the Mn content also coarsens precipitates such as MnS and can improve grain growth. Furthermore, Mn has the effect of increasing the electrical resistivity and reducing the iron loss. To achieve these effects, the Mn content is set to 0.02% or more. The Mn content is preferably 0.05% or more, more preferably 0.10% or more, and even more preferably 0.30% or more. No increase in the effects of adding Mn can be expected once Mn exceeds 2.0%, whereas the cost increases. Hence, the Mn content is set to 2.0% or less. The Mn content is preferably 1.8% or less, more preferably 1.6% or less, and even more preferably 1.4% or less.

Sol.Al: 2.0% or less

By precipitating as AlN, Al has the effect of suppressing nearby grain growth to allow fine grains to remain. Furthermore, Al has the effect of increasing the electrical resistivity and reducing the iron loss. However, no increase in the effects of adding Al can be expected once Al exceeds 2.0%. The Al content is therefore set to 2.0% or less. The Al content is preferably 1.5% or less and is more preferably 1.2% or less. No lower limit is particularly placed on the Al content, but to increase the electrical resistivity, the Al content is preferably 0.0010% or more, more preferably 0.01% or more, and even more preferably 0.10% or more.

P: 0.2% or less

P is an element that has the effect of promoting grain boundary segregation during hot band annealing and improving the texture of the final annealed sheet. However, no increase in the effects of adding P can be expected once P exceeds 0.2%. Moreover, the sheet becomes brittle and tends to fracture during cold rolling. Accordingly, the P content is set to 0.2% or less. The P content is preferably 0.1% or less and is more preferably 0.010% or less. No lower limit is particularly placed on the P content, but to increase the effect of adding P, the P content is preferably 0.001% or more and more preferably 0.004% or more.

Ti: 0.007% or less

Ti is a toxic element that has the effects of slowing down recovery/recrystallization and increasing {111} oriented grains, and Ti causes the magnetic flux density to degrade. Since these harmful effects become significant if the Ti content exceeds 0.007%, the Ti content is set to 0.007% or less. The Ti content is preferably 0.005% or less. No lower limit is particularly placed on the Ti content, but excessive reduction increases the raw material costs. Hence, the Ti content is preferably 0.0001% or more, more preferably 0.0003% or more, and even more preferably 0.0005% or more.

S: 0.005% or less

If the S content exceeds 0.005%, precipitates such as MnS increase and grain growth degrades. The S content is therefore set to 0.005% or less. The S content is preferably 0.003% or less. No lower limit is particularly placed on the S content, but setting the S content to less than 0.0001% leads to increased manufacturing costs. Hence, the S content is preferably 0.0001% or more, more preferably 0.0005% or more, and even more preferably 0.0010% or more.

One or both of As and Pb: total of 0.0005% to 0.005%

By including at least one of As and Pb with a total content of 0.0005% or more, precipitates such as MN can be caused to grow with precipitated As and/or Pb, or a compound thereof, as the nucleus, allowing the grain size distribution to be controlled appropriately. Accordingly, the total content of As and Pb is set to 0.0005% or more. The total content of As and Pb is preferably 0.0010% or more. On the other hand, no further effect is achieved by adding As and Pb upon the total content exceeding 0.005%, and the sheet becomes brittle and tends to fracture during cold rolling. Accordingly, the total content of As and Pb is set to 0.005% or less. The total content of As and Pb is preferably 0.003% or less and is more preferably 0.002% or less.

In addition to the above components, the balance of the chemical composition of a non-oriented electrical steel sheet and a steel slab in an embodiment of the present disclosure consists of Fe and inevitable impurities.

In another embodiment, the chemical composition may further contain one or both of Sn: 0.01% to 0.2% and Sb: 0.01% to 0.2%.

Sn: 0.01% to 0.2%

Sb: 0.01% to 0.2%

Sn and Sb are elements that have the effect of reducing {111} grains in the recrystallized texture and improving magnetic flux density. To achieve these effects, the content of Sn and Sb when these elements are added is set to 0.01% or more for each element. The Sn and Sb content is preferably 0.02% or more for each element. No further effects are achieved, however, upon excessive addition. Hence, when adding Sn and Sb, the content of each is set to 0.2% or less. The Sn and Sb content is preferably 0.1% or less for each element.

In another embodiment, the chemical composition may further contain one or more of REM: 0.0005% to 0.005%, Mg: 0.0005% to 0.005%, and Ca: 0.0005% to 0.005%.

REM: 0.0005% to 0.005%

Mg: 0.0005% to 0.005%

Ca: 0.0005% to 0.005%

Rare earth metals (REM), Mg, and Ca are elements that have the effect of coarsening sulfides and of improving grain growth. To achieve these effects when adding REM, Mg, and Ca, the content of each of these elements is set to 0.0005% or more. The REM, Mg, and Ca content is preferably 0.0010% or more for each element. However, since excessive addition actually causes grain growth to worsen, the REM, Mg, and Ca content when these elements are added is set to 0.005% or less for each element. The REM, Mg, and Ca content is preferably 0.003% or less for each element.

[Grain Size]

Furthermore, in the present disclosure, it is important that an average grain size r be 40 μm or more and 120 μm or less, that an area ratio R of grains having a grain size of ⅙ or less of the thickness of the steel sheet (hereafter also simply referred to as "area ratio R") be 2% or greater, and that the average grain size r (μm) and the area ratio R (%) satisfy the condition represented by Expression (1) below. As a result, the iron loss can be reduced in the case of excitation under PWM control using an inverter. The reasons for these limitations are described below.

$$R>-2.4\times r+200 \quad (1)$$

Average grain size r: 40 μm to 120 μm

Figure 2:
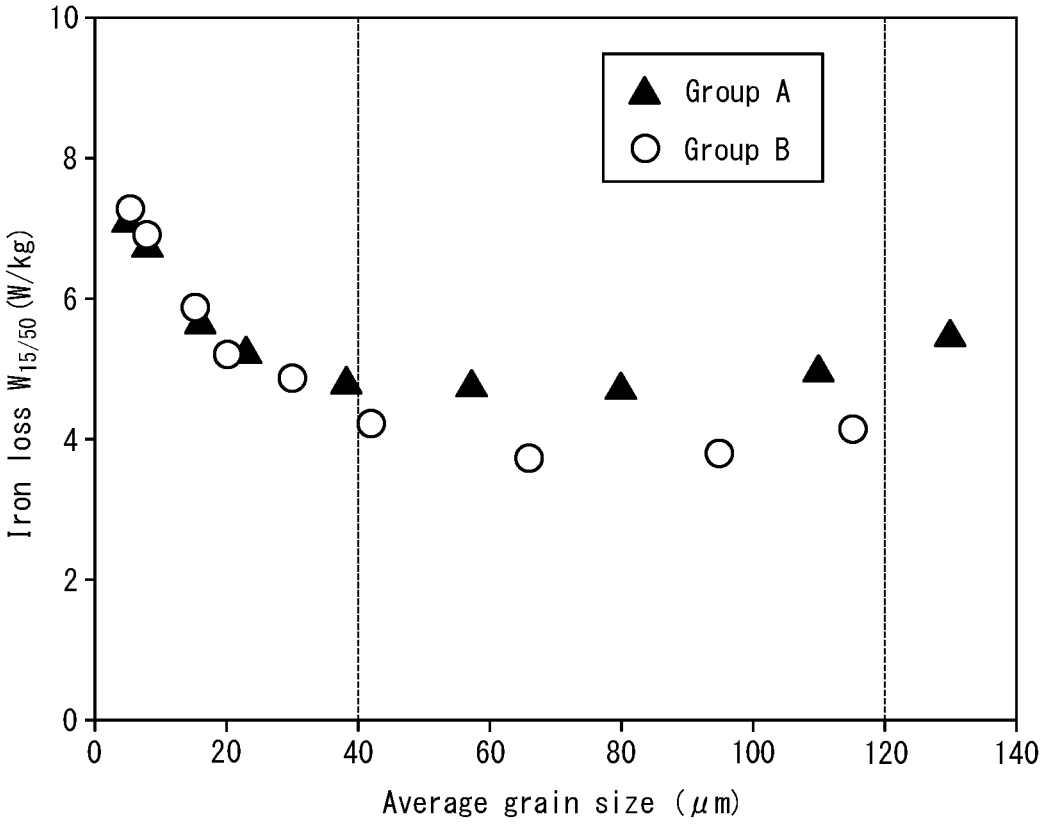
FIG. 2 illustrates the relationship between iron loss under inverter excitation and average grain size.
Figure 3:
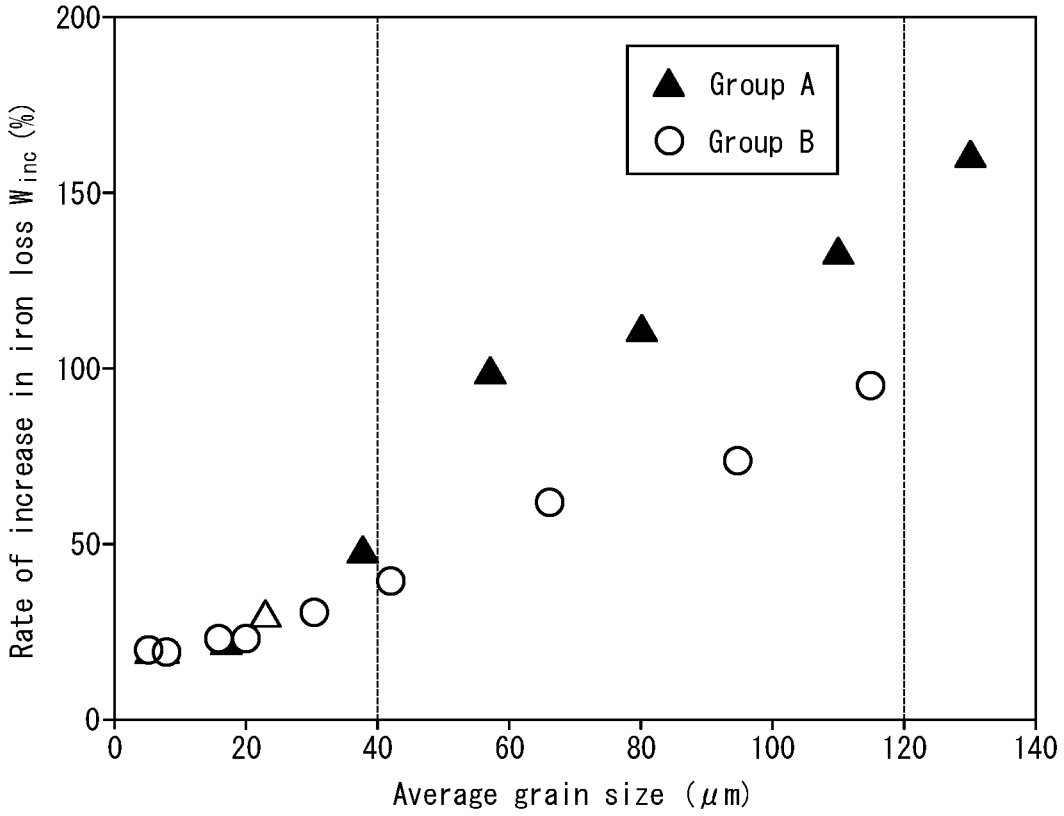
FIG. 3 illustrates the relationship between the rate of increase in iron loss $W_{inc}$ and the average grain size.

As illustrated in FIG. 1 and FIG. 2, setting the average grain size to be 40 μm to 120 μm can reduce the iron loss both under sinusoidal excitation and under inverter excitation. To reduce the iron loss further, the average grain size r is preferably set to 60 μm or more. Also, to reduce the iron loss further, the average grain size r is preferably set to 100 μm or less. The average grain size r referred to here is the average grain size measured in a cross-section yielded by cutting a non-oriented electrical steel sheet in the thickness direction, parallel to the rolling direction, at the center in the sheet transverse direction. The average grain size r can be measured by the method described in the Examples. The average grain size of a non-oriented electrical steel sheet used as a motor iron core is considered to be the average grain size obtained by the same measurement as above on a cross-section of a test piece cut out from a portion of the iron core.

Area ratio R: 2% or more, and R>−2.4×r+200

If the area ratio R, which is the ratio of the total area of the grains having a grain size of ⅙ or less of the thickness of the steel sheet to the cross-sectional area of the steel sheet, is low, then the iron loss increases as a result of increased primary current under inverter excitation. The area ratio R is therefore set to 2% or higher and set to satisfy R>−2.4×r+200. To decrease the iron loss under inverter excitation further, the area ratio R (%) and the average grain size r (μm) more preferably satisfy the relationship in Expression (2) below and even more preferably satisfy the relationships in Expressions (3) and (4) below simultaneously.

$$-2.4\times r+280>R>-2.4\times r+210 \quad (2)$$

$$-2.4\times r+260>R>-2.4\times r+230 \quad (3)$$

$$80\geq R\geq 40 \quad (4)$$

[Sheet Thickness]

Sheet thickness: 0.35 mm or less

No limit is particularly placed on the sheet thickness of the non-oriented electrical steel sheet in the present disclosure, and the steel sheet may be any thickness. However, setting the sheet thickness to 0.35 mm or less can reduce the eddy current loss. Since the ratio of eddy current loss particularly increases from the effect of harmonics under inverter excitation, the effect of iron loss reduction due to reducing the thickness of the steel sheet increases. Accordingly, the thickness of the non-oriented electrical steel sheet is preferably 0.35 mm or less. The sheet thickness is more preferably 0.30 mm or less. If the steel sheet is excessively thin, however, the increase in hysteresis loss exceeds the reduction in eddy current loss, and iron loss ends up increasing. Accordingly, the thickness of the non-oriented electrical steel sheet is preferably 0.05 mm or more and is more preferably 0.15 mm or more.

[Magnetic Properties]

By controlling the chemical composition and the grain size as described above, a non-oriented electrical steel sheet with excellent magnetic properties under inverter excitation can be obtained. No limit is particularly placed on the magnetic properties of the non-oriented electrical steel sheet according to the present disclosure, but the rate of increase in iron loss $W_{inc}$ (%), defined as $100(W_{inv}-W_{sin})/W_{sin}$, is preferably 100% or less, where $W_{sin}$ is the iron loss under sinusoidal excitation, and $W_{inv}$ is the iron loss under inverter excitation. If $W_{inc}$ is large, even material with low iron loss under sinusoidal excitation ends up with increased loss when used as the iron core of a motor controlled by an inverter. $W_{inc}$ is more preferably 90% or less.

$W_{sin}$ and $W_{inv}$ are defined as follows.

$W_{sin}$: the iron loss measured when performing excitation at a maximum magnetic flux density of 1.5 T and with sinusoidal alternating current at a frequency of 50 Hz.

$W_{inv}$: the iron loss measured when performing excitation by PWM control using an inverter at a maximum magnetic flux density of 1.5 T, a fundamental frequency of 50 Hz, a carrier frequency of 1 kHz, and a modulation factor of 0.4.

Unlike the magnetic properties under sinusoidal excitation, the magnetic properties under inverter excitation are greatly affected by the magnetic path cross-sectional area of the test piece used for measurement and the number of turns of the winding. Therefore, $W_{sin}$ and $W_{inv}$ are taken as the values measured using a test piece with a magnetic path cross-sectional area of 70 $mm^2$, a primary winding of 120 turns, and a secondary winding of 100 turns. During PWM control with an inverter, the modulation factor and the carrier frequency are affected by the amplitude and frequency of the high-harmonic component, and iron loss increases and decreases. Hence, $W_{inv}$ is measured with the inverter control conditions set to a modulation factor of 0.4 and a carrier frequency of 1 kHz.

Next, a method for manufacturing a non-oriented electrical steel sheet according to an embodiment of the present disclosure is described. A non-oriented electrical steel sheet according to the present disclosure can be manufactured by subjecting a steel slab with the aforementioned chemical composition to hot rolling, hot band annealing, cold rolling, and final annealing.

[Steel Slab]

The steel slab subjected to hot rolling may be any steel slab with the aforementioned chemical composition. The steel slab can, for example, be manufactured from molten steel, adjusted to the aforementioned chemical composition, using a typical ingot casting and blooming method or a continuous casting method. Alternatively, a thin slab or thinner cast steel with a thickness of 100 mm or less may be produced using a direct casting method. C, Al, B, and Se are elements that easily become mixed in during the steelmaking process and therefore must be strictly controlled.

[Hot Rolling]

Next, the resulting slab is subjected to hot rolling to obtain a hot rolled sheet. The slab can be subjected to hot rolling after being heated or can be subjected to hot rolling directly after casting, without being heated.

[Hot Band Annealing]

After the hot rolling, the resulting hot rolled sheet is subjected to hot band annealing. In the present disclosure, soaking during the hot band annealing is performed in two stages: a first soaking treatment and a second soaking treatment. The reasons for the limitations on the conditions of the first soaking treatment and the second soaking treatment are described below.

(First Soaking Treatment)

$T_1$: 800° C. to 1100° C.

If the soaking temperature $T_1$ during the first soaking treatment is less than 800° C., the band texture formed at the time of hot rolling remains, so that ridging tends to occur. Accordingly, $T_1$ is set to 800° C. or higher. $T_1$ is preferably 850° C. or higher and more preferably 900° C. or higher. Conversely, if $T_1$ exceeds 1100° C., the annealing cost increases. $T_1$ is thus preferably 1100° C. or lower and more preferably 1050° C. or lower.

$t_1$: 5 min or less

The soaking time $t_1$ during the first soaking treatment is set to 5 min or less, since productivity decreases if $t_1$ is excessively long. The soaking time $t_1$ is preferably 2 min or less, more preferably 60 s or less, even more preferably 30 s or less, and most preferably 20 s or less. No lower limit is particularly placed on $t_1$, but to obtain the effects of the first soaking treatment sufficiently, $t_1$ is preferably 5 s or more.

(Second Soaking Treatment)

$T_2$: 1150° C. to 1200° C.

If the soaking temperature $T_2$ during the second soaking treatment is 1150° C. or higher, the precipitates in the steel can be temporarily dissolved and then finely precipitated during cooling. Accordingly, $T_2$ is set to 1150° C. or higher. Conversely, if $T_2$ exceeds 1200° C., the annealing cost increases. Accordingly, $T_2$ is set to 1200° C. or less.

$t_2$: 5 s or Less

For a non-uniform distribution of fine precipitates, the soaking time $t_2$ during the second soaking treatment needs to be shortened. Accordingly, $t_2$ is set to 5 s or less. No lower limit is particularly placed on $t_2$, but to sufficiently obtain the effects of the second soaking treatment, $t_2$ is preferably 1 s or more and more preferably 2 s or more. In combination with the addition of small amounts of As and Pb, performing the second soaking treatment in this way makes the distribution of fine precipitates even more non-uniform, yielding the effect of a non-uniform grain size after the final annealing.

The hot band annealing can be performed by any method. Specifically, the hot band annealing can be performed by heating the hot rolled sheet to the soaking temperature $T_1$ and holding at $T_1$ for the soaking time $t_1$, and subsequently heating the hot rolled sheet to the soaking temperature $T_2$ and holding at $T_2$ for the soaking time $t_2$. Since soaking using a batch annealing furnace has low productivity, the hot band annealing is preferably performed using a continuous annealing furnace. The cooling rate after the second soaking treatment does not affect the magnetic properties and is therefore not limited. The hot rolled sheet can, for example, be cooled at a cooling rate of 1° C./s to 100° C./s.

[Cold Rolling]

Next, the annealed hot rolled sheet is subjected to cold rolling to obtain a cold rolled steel sheet with a final sheet thickness. The annealed hot rolled sheet is preferably subjected to pickling before the cold rolling. The cold rolling may be performed once or performed twice or more with intermediate annealing in between. The intermediate annealing may be performed under any conditions but is preferably performed, for example, using a continuous annealing furnace under the conditions of a soaking temperature of 800° C. to 1200° C. and a soaking time of 5 min or less.

The cold rolling can be performed under any conditions. To promote formation of a distortion zone and develop the {001}<250>texture, however, at least the rolling delivery-side material temperature for one pass is preferably 100° C. to 300° C. If the rolling delivery-side material temperature is 100° C. or higher, development of the {111} orientation can be suppressed. If the rolling delivery-side material temperature is 300° C. or less, randomization of the texture can be suppressed. The rolling delivery-side material temperature can be measured with a radiation thermometer or a contact thermometer.

The rolling reduction during the cold rolling may be any value. To improve the magnetic properties, however, the rolling reduction in the final cold rolling is preferably 80% or more. Setting the rolling reduction in the final cold rolling to 80% or more increases the sharpness of the texture and can further improve the magnetic properties. No upper limit is particularly placed on the rolling reduction, but the rolling cost significantly increases if the rolling reduction exceeds 98%. Hence, the rolling reduction is preferably 98% or less.

The rolling reduction is more preferably 85% to 95%. Here, the "final cold rolling" refers to the only instance of cold rolling when cold rolling is performed once and refers to the last instance of cold rolling when cold rolling is performed twice or more.

No limit is particularly placed on the final sheet thickness, which may be the same as the sheet thickness of the above-described non-oriented electrical steel sheet. To increase the rolling reduction, the final sheet thickness is preferably 0.35 mm or less and more preferably 0.30 mm or less.

[Final Annealing]

After the final cold rolling, final annealing is performed. No limit is particularly placed on the soaking temperature during the final annealing. It suffices to adjust the soaking temperature to achieve the desired grain size. The soaking temperature can, for example, be from 700° C. to 1100° C. No limit is particularly placed on the soaking time during the final annealing. It suffices to perform the final annealing long enough for recrystallization to progress. The soaking time can, for example, be 5 s or longer. If the soaking time is excessively long, however, no further effects are achieved, and productivity falls. Hence, the soaking time is preferably 120 s or less.

Heating rate: 30° C./s to 300° C./s

During the final annealing, the heating rate from 400° C. to 740° C. is set to 30° C./s to 300° C./s. Setting the heating rate to 30° C./s to 300° C./s allows the grain size to be set to an appropriate distribution. If the heating rate is less than 30° C./s, the grain size distribution becomes sharp, and the number of grains that have an advantageous size with respect to iron loss under inverter excitation suddenly decreases. Conversely, if the heating rate is higher than 300° C./s, no further effect of securing fine grains is obtained, and buckling occurs in the plate shape. Costs also increase, since a vast amount of power becomes necessary. The heating rate is preferably 50° C./s or higher. Also, the heating rate is preferably 200° C./s or less. The heating rate refers to the average heating rate from 400° C. to 740° C. When the soaking temperature is less than 740° C., the average heating rate from 400° C. up to the soaking temperature is considered to be the heating rate.

After the final annealing, an insulating coating is applied as necessary, thereby obtaining a product sheet. Any type of insulating coating may be used in accordance with the purpose, such as an inorganic coating, an organic coating, or an inorganic-organic mixed coating.

EXAMPLES

Example 1

In a laboratory, steel having the chemical composition in Table 1 was melted and cast to obtain steel raw material (a slab). The steel raw material was then subjected sequentially to the following treatments (1) to (5) to produce non-oriented electrical steel sheets.

(1) Hot rolling to a sheet thickness of 2.0 mm,
(2) Hot band annealing,
(3) Pickling,
(4) Cold rolling, and
(5) Final annealing at a soaking temperature of 850° C. to 1100° C. and a soaking time of 10 s.

During the (2) hot band annealing, two-stage soaking treatment consisting of (2-1) and (2-2) below was performed.

(2-1) A first soaking treatment with a soaking temperature of $T_1$ (° C.) and a soaking time of $t_1$ (s), and
(2-2) A second soaking treatment with a soaking temperature of $T_2$ (° C.) and a soaking time of $t_2$ (s).

Table 2 lists the treatment conditions during each process. For the sake of comparison, the second soaking treatment was not performed in some examples. When not performing the second soaking treatment, cooling was performed after the first soaking treatment.

The final sheet thickness during the cold rolling was set to 0.175 mm, 0.25 mm, or 0.70 mm. During the final annealing, heating up to 740° C. was performed with an induction heating apparatus, and the output was controlled so that the heating rate was 20° C./s from room temperature to 400° C. and was 20° C./s to 200° C./s from 400° C. to 740° C. Heating from 740° C. onward was performed in an electric heating furnace, and the average heating rate up to the soaking temperature was set to 10° C./s. Table 2 lists the final annealing conditions of each non-oriented electrical steel sheet. The atmosphere of the final annealing was $H_2$:$N_2$=2:8, and the cloud point was −20° C. ($P_{H2O}/P_{H2}$=0.006).

The grain size and magnetic properties of each of the non-oriented electrical steel sheets (final annealed sheets) obtained in the above way were evaluated with the following method.

[Average Grain Size r]

The average grain size r of each of the resulting non-oriented electrical steel sheets was measured. The measurement was made in a cross-section yielded by cutting the non-oriented electrical steel sheet in the thickness direction, parallel to the rolling direction, at the center in the sheet transverse direction. The cut cross-section was polished, etched, and subsequently observed under an optical microscope. The size of 1000 or more grains was measured by a line segment method to calculate the average grain size r. Table 2 lists the resulting values.

[Area Ratio R]

By the same method as for measurement of the average grain size r, a cross-section of the steel sheet was observed, and the area ratio R of the total area of grains having a grain size of ⅙ or less of the sheet thickness to the cross-sectional area of the steel sheet was calculated. Table 2 lists the resulting values.

[Magnetic Properties]

Using the resulting non-oriented electrical steel sheets, ring test pieces for evaluating magnetic properties were produced by the following procedure. First, the non-oriented electrical steel sheets were processed by wire cutting into ring shapes with an outer diameter of 110 mm and an inner diameter of 90 mm. The cut non-oriented electrical steel sheets were stacked to a stacking thickness of 7.0 mm, and a primary winding with 120 turns and a secondary winding with 100 turns were wound around the stack, yielding a ring test piece (magnetic path cross-sectional area of 70 $mm^2$).

Next, the magnetic properties of the ring test piece were evaluated under two conditions: sinusoidal excitation and inverter excitation. Table 2 lists the following values obtained by this measurement.

$W_{sin}$: the iron loss measured when performing excitation at a maximum magnetic flux density of 1.5 T and with sinusoidal alternating current at a frequency of 50 Hz.

$W_{inv}$: the iron loss measured when performing excitation by PWM control using an inverter at a maximum magnetic flux density of 1.5 T, a fundamental frequency of 50 Hz, a carrier frequency of 1 kHz, and a modulation factor of 0.4.

Rate of increase in iron loss $W_{inc}$ (%)=100($W_{inv}$−$W_{sin}$)/$W_{sin}$

TABLE 1

| Steel sample | Chemical composition (mass %)* | | | | | | | | | |
|---|---|---|---|---|---|---|---|---|---|---|
| ID | C | Si | Mn | Sol. Al | P | Ti | S | As | Pb | Notes |
| C | 0.0010 | 3.7 | 0.8 | 1.4 | 0.005 | 0.002 | 0.001 | 0.0009 | 0.0009 | Conforming steel |
| D | 0.0009 | 3.2 | 1.6 | 0.5 | 0.006 | 0.002 | 0.001 | 0.0009 | 0.0009 | Conforming steel |
| E | 0.0007 | 3.3 | 0.1 | 0.001 | 0.005 | 0.002 | 0.001 | 0.0009 | 0.0009 | Conforming steel |

*Balance consisting of Fe and inevitable impurities

TABLE 2

| | | Manufacturing conditions | | | | | | | | | | | | | |
|---|---|---|---|---|---|---|---|---|---|---|---|---|---|---|---|
| | | | | | | | Final annealing | | | | | | | | |
| | Steel | Final sheet | Hot band annealing | | | | Soaking | Heating | Evaluation results | | | | | | |
| No. | sample ID | thickness (mm) | $T_1$ (° C.) | $t_1$ (s) | $T_2$ (° C.) | $t_2$ (s) | temperature (° C.) | rate* (° C./s) | r (μm) | R (%) | −2.4 × r + 200 | $W_{sin}$ (W/kg) | $W_{inv}$ (W/kg) | $W_{inc}$ (%) | Notes |
| 1 | C | 0.7 | 1000 | 10 | 1150 | 3 | 950 | 150 | 80 | 85 | 8 | 7.01 | 12.94 | 84.59 | Example |
| 2 | C | 0.7 | 1000 | 10 | 1150 | 3 | 950 | 200 | 80 | 91 | 8 | 7.13 | 13.86 | 94.39 | Example |
| 3 | C | 0.7 | 1000 | 10 | 1150 | 3 | 1100 | 150 | 110 | 10 | −64 | 6.88 | 12.98 | 88.66 | Example |
| 4 | C | 0.7 | 1000 | 10 | 1150 | 3 | 1100 | 200 | 110 | 20 | −64 | 6.92 | 13.66 | 97.40 | Example |
| 5 | D | 0.175 | 1000 | 5 | 1150 | 3 | 950 | 100 | 91 | 4 | −18.4 | 1.92 | 3.22 | 67.71 | Example |
| 6 | D | 0.25 | 1000 | 5 | 1150 | 3 | 950 | 100 | 91 | 12 | −18.4 | 2.22 | 3.92 | 76.58 | Example |
| 7 | D | 0.7 | 1000 | 5 | 1150 | 3 | 950 | 100 | 90 | 52 | −16 | 7.23 | 12.88 | 78.15 | Example |
| 8 | E | 0.25 | 1000 | 30 | 1150 | 3 | 900 | 20 | 63 | 45 | 48.8 | 2.46 | 5.11 | 107.72 | Comparative Example |
| 9 | E | 0.25 | 1000 | 30 | 1150 | 3 | 900 | 50 | 62 | 55 | 51.2 | 2.55 | 4.36 | 70.98 | Example |
| 10 | E | 0.25 | 1000 | 30 | 1150 | 3 | 900 | 100 | 63 | 67 | 48.8 | 2.62 | 3.88 | 48.09 | Example |
| 11 | E | 0.25 | 1000 | 30 | 1150 | 3 | 850 | 20 | 50 | 75 | 80 | 2.61 | 5.32 | 103.83 | Comparative Example |
| 12 | E | 0.25 | 1000 | 30 | 1150 | 3 | 850 | 50 | 50 | 84 | 80 | 2.68 | 4.26 | 58.96 | Example |
| 13 | E | 0.25 | 1000 | 30 | 1150 | 3 | 850 | 100 | 50 | 92 | 80 | 2.69 | 3.98 | 47.96 | Example |
| 14 | D | 0.25 | 1000 | 60 | 1150 | 3 | 950 | 100 | 92 | 9 | −20.8 | 2.19 | 3.95 | 80.37 | Example |
| 15 | D | 0.25 | 900 | 60 | 1150 | 3 | 950 | 100 | 89 | 10 | −13.6 | 2.22 | 3.86 | 73.87 | Example |
| 16 | D | 0.25 | 1050 | 60 | 1150 | 3 | 950 | 100 | 92 | 11 | −20.8 | 2.17 | 3.85 | 77.42 | Example |
| 17 | D | 0.25 | 1000 | 10 | 1200 | 3 | 950 | 100 | 97 | 23 | −32.8 | 2.11 | 3.91 | 85.31 | Example |
| 18 | D | 0.25 | 1000 | 10 | 1150 | 5 | 950 | 100 | 93 | 6 | −23.2 | 2.14 | 3.94 | 84.11 | Example |
| 19 | D | 0.25 | 1150 | 10 | — | — | 950 | 100 | 94 | 1 | −25.6 | 2.31 | 5.12 | 121.65 | Comparative Example |
| 20 | D | 0.25 | 1000 | 10 | — | — | 950 | 100 | 90 | 0 | −16 | 2.15 | 5.06 | 135.35 | Comparative Example |
| 21 | D | 0.25 | 1000 | 10 | 1125 | 3 | 950 | 100 | 89 | 1 | −13.6 | 2.21 | 5.21 | 135.75 | Comparative Example |
| 22 | D | 0.25 | 1000 | 10 | 1150 | 8 | 950 | 100 | 76 | 15 | 17.6 | 2.46 | 4.97 | 102.03 | Comparative Example |

*Average heating rate from 400° C. to 740° C.

As is clear from the results in Table 2, the non-oriented electrical steel sheets satisfying the conditions of the present disclosure have low iron loss under inverter excitation. By contrast, in the non-oriented electrical steel sheets of the Comparative Examples that do not satisfy the conditions of the present disclosure, the rate of increase in iron loss $W_{inc}$ exceeds 100%, and iron loss degrades under inverter excitation.

Example 2

In a laboratory, steel having the chemical composition in Table 3 was melted and cast to obtain steel raw material. The steel raw material was then subjected sequentially to the following treatments (1) to (5) to produce non-oriented electrical steel sheets.

(1) Hot rolling to a sheet thickness of 1.8 mm, (2) Hot band annealing, (3) Pickling, (4) Cold rolling to a final sheet thickness of 0.35 mm, and (5) Final annealing at a soaking temperature of 900° C. to 1000° C. and a soaking time of 10 s.

During the (2) hot band annealing, two-stage soaking treatment consisting of (2-1) and (2-2) below was performed.

(2-1) A first soaking treatment with a soaking temperature of 1000° C. and a soaking time of 10 s, and (2-2) A second soaking treatment with a soaking temperature of 1150° C. and a soaking time of 3 s.

During the final annealing, heating up to 740° C. was performed with an induction heating apparatus, and the output was controlled so that the heating rate was 20° C./s from room temperature to 400° C. and was 30° C./s to 300° C./s from 400° C. to 740° C. The other conditions were the same as those in Example 1. The average grain size and the magnetic properties of each of the resulting non-oriented electrical steel sheets were evaluated with the same methods as in Example 1. Table 4 lists the final annealing conditions and the evaluation results of each non-oriented electrical steel sheet.

TABLE 3

| Steel sample | Chemical composition (mass %)* | | | | | | | | | | | | | | |
|---|---|---|---|---|---|---|---|---|---|---|---|---|---|---|---|
| ID | C | Si | Mn | Sol. Al | P | Ti | S | As | Pb | Sn | Sb | REM | Mg | Ca | Notes |
| F | 0.0009 | 3.2 | 0.5 | 0.19 | 0.005 | 0.002 | 0.001 | 0.0007 | 0.0006 | 0.02 | 0.0001 | 0.0001 | 0.0001 | 0.0001 | Conforming steel |
| G | 0.0009 | 3.2 | 0.49 | 0.19 | 0.005 | 0.002 | 0.001 | 0.0008 | 0.001 | 0.0001 | 0.015 | 0.0001 | 0.0001 | 0.0001 | Conforming steel |
| H | 0.0009 | 3.2 | 0.48 | 0.19 | 0.005 | 0.002 | 0.001 | 0.0007 | 0.0007 | 0.0001 | 0.1 | 0.0001 | 0.0001 | 0.0001 | Conforming steel |
| I | 0.0009 | 3.2 | 0.5 | 0.21 | 0.005 | 0.002 | 0.001 | 0.004 | 0.0007 | 0.0001 | 0.0001 | 0.001 | 0.0001 | 0.0001 | Conforming steel |
| J | 0.0009 | 3.2 | 0.49 | 0.2 | 0.005 | 0.002 | 0.001 | 0.001 | 0.001 | 0.0001 | 0.0001 | 0.0001 | 0.004 | 0.0001 | Conforming steel |
| K | 0.0009 | 3.2 | 0.52 | 0.21 | 0.005 | 0.002 | 0.001 | 0.0009 | 0.0009 | 0.0001 | 0.0001 | 0.0001 | 0.0007 | 0.0001 | Conforming steel |
| L | 0.0009 | 3.2 | 0.5 | 0.19 | 0.005 | 0.002 | 0.001 | 0.0007 | 0.0007 | 0.0001 | 0.0001 | 0.0001 | 0.0001 | 0.001 | Conforming steel |
| M | 0.0009 | 3.2 | 0.52 | 0.19 | 0.005 | 0.002 | 0.001 | 0.0007 | 0.0001 | 0.0001 | 0.0001 | 0.0001 | 0.0001 | 0.0001 | Conforming steel |
| N | 0.0009 | 3.2 | 0.52 | 0.19 | 0.005 | 0.002 | 0.001 | 0.0001 | 0.0001 | 0.0001 | 0.0001 | 0.0001 | 0.0001 | 0.0001 | Comparative steel |
| O | 0.0009 | 3.2 | 0.52 | 0.19 | 0.005 | 0.002 | 0.001 | 0.0001 | 0.0007 | 0.0001 | 0.0001 | 0.0001 | 0.0001 | 0.0001 | Conforming steel |

*Balance consisting of Fe and inevitable impurities

TABLE 4

| | | Manufacturing conditions Final annealing | | Evaluation results | | | | | | |
|---|---|---|---|---|---|---|---|---|---|---|
| No. | Steel sample ID | Soaking temperature (° C.) | Heating rate* (° C./s) | r (μm) | R (%) | −2.4 × r + 200 | $W_{sin}$ (W/kg) | $W_{inv}$ (W/kg) | $W_{inc}$ (%) | Notes |
| 23 | F | 1000 | 30 | 90 | 22 | −16 | 2.35 | 4.32 | 83.83 | Example |
| 24 | G | 1000 | 30 | 92 | 24 | −20.8 | 2.32 | 4.25 | 83.19 | Example |
| 25 | H | 1000 | 30 | 90 | 21 | −16 | 2.29 | 4.22 | 84.28 | Example |
| 26 | I | 1000 | 30 | 91 | 23 | −18.4 | 2.21 | 4.08 | 84.62 | Example |
| 27 | J | 1000 | 30 | 91 | 22 | −18.4 | 2.35 | 4.33 | 84.26 | Example |
| 28 | K | 1000 | 30 | 92 | 22 | −20.8 | 2.26 | 4.15 | 83.63 | Example |
| 29 | L | 1000 | 30 | 91 | 19 | −18.4 | 2.35 | 4.42 | 88.09 | Example |
| 30 | M | 1000 | 30 | 90 | 15 | −16 | 2.36 | 4.44 | 88.14 | Example |
| 31 | N | 1000 | 30 | 92 | 5 | −20.8 | 2.31 | 5.11 | 121.21 | Comparative Example |
| 32 | O | 950 | 30 | 80 | 15 | 8 | 2.35 | 4.59 | 95.32 | Example |
| 33 | O | 950 | 50 | 80 | 35 | 8 | 2.34 | 4.29 | 83.33 | Example |
| 34 | O | 950 | 100 | 81 | 50 | 5.6 | 2.37 | 3.98 | 67.93 | Example |
| 35 | O | 950 | 200 | 79 | 65 | 10.4 | 2.31 | 3.81 | 64.94 | Example |
| 36 | O | 950 | 300 | 80 | 80 | 8 | 2.43 | 4.49 | 84.77 | Example |
| 37 | O | 900 | 100 | 63 | 52 | 48.8 | 2.51 | 4.61 | 83.67 | Example |
| 38 | O | 925 | 100 | 69 | 52 | 34.4 | 2.48 | 4.35 | 75.40 | Example |
| 39 | O | 950 | 100 | 76 | 50 | 17.6 | 2.42 | 3.93 | 62.40 | Example |
| 40 | O | 975 | 100 | 85 | 50 | −4 | 2.4 | 3.81 | 58.75 | Example |
| 41 | O | 1000 | 100 | 90 | 48 | −16 | 2.37 | 4.31 | 81.86 | Example |
| 42 | O | 935 | 100 | 70 | 85 | 32 | 2.51 | 4.47 | 78.09 | Example |

*Average heating rate from 400° C. to 740° C.

As is clear from the results in Table 4, the non-oriented electrical steel sheets satisfying the conditions of the present disclosure have low iron loss under inverter excitation. By contrast, in the non-oriented electrical steel sheets of the Comparative Examples that do not satisfy the conditions of the present disclosure, the rate of increase in iron loss $W_{inc}$ exceeds 100%, and iron loss degrades under inverter excitation.

Figure 4:
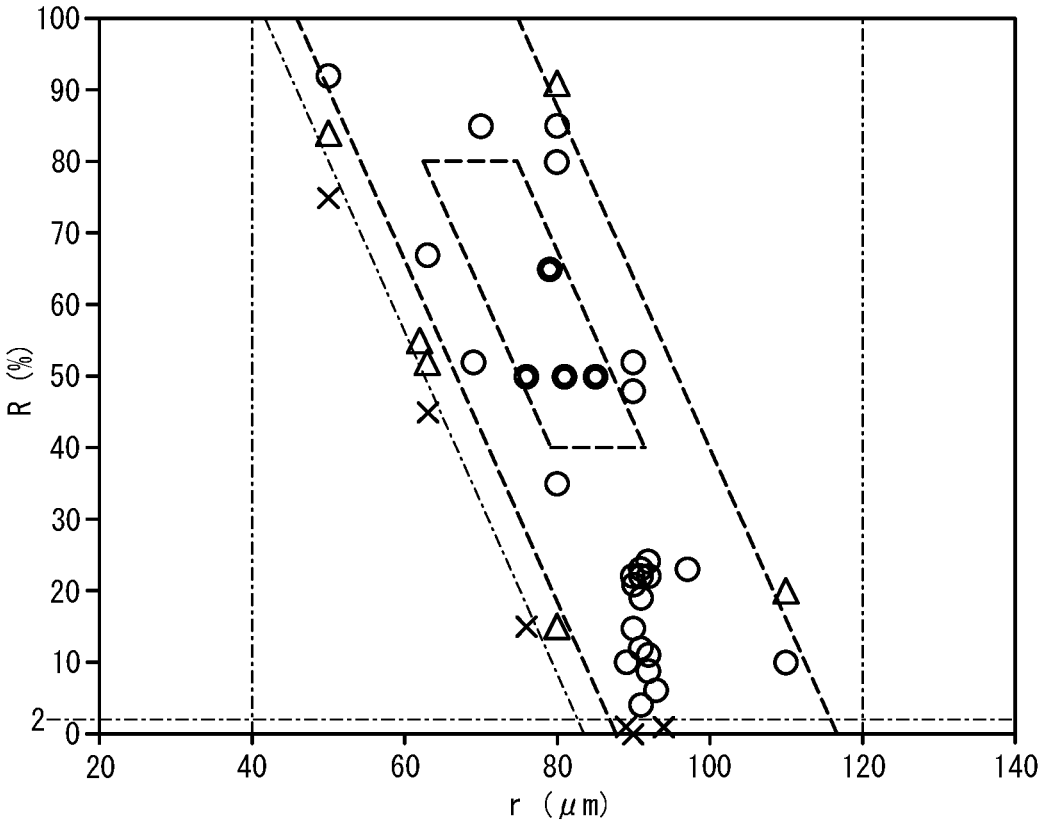
FIG. 4 illustrates the ranges of the area ratio R and the average grain size r that achieve satisfactory iron loss under inverter excitation.

In FIG. 4, the result of the average grain size r is plotted on the horizontal axis and the result of the area ratio R on the vertical axis for all of the non-oriented electrical steel sheets, in Example 1 and Example 2, for which the steel chemical composition satisfies the conditions of the present disclosure. In FIG. 4, the iron loss under inverter excitation $W_{inv}$, in the Examples and the Comparative Examples was classified on the basis of the evaluation criteria in Table 5 and plotted using symbols corresponding to the classifications. As is clear from this figure, a non-oriented electrical steel sheet with low iron loss under inverter excitation can be obtained by controlling R and r to be within appropriate ranges.

TABLE 5

| | | Iron loss under inverter excitation: $W_{inv}$ | | | |
|---|---|---|---|---|---|
| Symbol | Evaluation | Sheet thickness of 0.7 mm | Sheet thickness of 0.35 mm | Sheet thickness of 0.25 mm | Sheet thickness of 0.175 mm |
| Double circle | Region with extremely low iron loss | 12 W/kg or less | 4.0 W/kg or less | 3.5 W/kg or less | 3.0 W/kg or less |
| Circle | Region with particularly low iron loss | over 12 W/kg to 13 W/kg | over 4.0 W/kg to 4.5 W/kg | over 3.5 W/kg to 4.0 W/kg | 3.0 W/kg to 3.5 W/kg |
| Triangle | Region with low iron loss | over 13 W/kg to 14 W/kg | over 4.5 W/kg to 5.0 W/kg | over 4.0 W/kg to 4.5 W/kg | 3.5 W/kg to 4.0 W/kg |
| X | Region with significantly degraded iron loss | over 14 W/kg | over 5.0 W/kg | over 4.5 W/kg | over 4.0 W/kg |

The invention claimed is:

1. A non-oriented electrical steel sheet comprising:

a chemical composition containing, in mass %,

C: 0.005% or less,

Si: 4.5% or less,

Mn: 0.02% to 2.0%,

Sol.Al: 2.0% or less,

P: 0.2% or less,

Ti: 0.007% or less,

S: 0.005% or less, one or both of As and Pb: total of 0.0005% to 0.005%, and the balance consisting of Fe and inevitable impurities;

wherein an average grain size r, measured in a cross-sectional area of the steel sheet, is 40 μm to 120 μm, wherein an area ratio R, in percentage, of a total area of grains having a grain size of ⅙ or less of a thickness of the steel sheet in the cross-sectional area of the steel sheet is 2% or greater, wherein the average grain size r μm and the area ratio R % satisfy a condition represented by Expression (1), $$R>-2.4\times r+200 \quad (1),$$

wherein the cross-sectional area of the steel sheet is an area of a cross-section yielded by cutting the non-oriented electrical steel sheet in a thickness direction, parallel to a rolling direction, at a center in a sheet transverse direction, and wherein the thickness of the steel sheet is 0.35 mm or less.

2. The non-oriented electrical steel sheet of claim 1, wherein the chemical composition further contains, in mass %, one or both of Sn: 0.01% to 0.2% and Sb: 0.01% to 0.2%.

3. The non-oriented electrical steel sheet of claim 2, wherein a rate of increase in iron loss $W_{inc}$ % calculated as $100(W_{inv}-W_{sin})/W_{sin}$ is 100% or less, where using a ring test piece having a magnetic path cross-sectional area of 70 $mm^2$ and having wound thereon a wiring with a primary winding number of 120 turns and a secondary winding number of 100 turns, iron loss $W_{inv}$ is measured when performing excitation by pulse width modulation control using an inverter at a maximum magnetic flux density of 1.5 T, a fundamental frequency of 50 Hz, a carrier frequency of 1 kHz, and a modulation factor of 0.4, and iron loss $W_{sin}$ is measured when performing excitation at a maximum magnetic flux density of 1.5 T and with sinusoidal alternating current at a frequency of 50 Hz.

4. The non-oriented electrical steel sheet of claim 2, wherein the chemical composition further contains, in mass %, one or more of REM: 0.0005% to 0.005%, Mg: 0.0005% to 0.005%, and Ca: 0.0005% to 0.005%.

5. The non-oriented electrical steel sheet of claim 4, wherein a rate of increase in iron loss $W_{inc}$ % calculated as $100(W_{inv}-W_{sin})/W_{sin}$ is 100% or less, where using a ring test piece having a magnetic path cross-sectional area of 70 $mm^2$ and having wound thereon a wiring with a primary winding number of 120 turns and a secondary winding number of 100 turns, iron loss $W_{inv}$ is measured when performing excitation by pulse width modulation control using an inverter at a maximum magnetic flux density of 1.5 T, a fundamental frequency of 50 Hz, a carrier frequency of 1 kHz, and a modulation factor of 0.4, and iron loss $W_{sin}$ is measured when performing excitation at a maximum magnetic flux density of 1.5 T and with sinusoidal alternating current at a frequency of 50 Hz.

6. The non-oriented electrical steel sheet of claim 1, wherein the chemical composition further contains, in mass %, one or more of REM: 0.0005% to 0.005%, Mg: 0.0005% to 0.005%, and Ca: 0.0005% to 0.005%.

7. The non-oriented electrical steel sheet of claim 6, wherein a rate of increase in iron loss $W_{inc}$ % calculated as $100(W_{inv}-W_{sin})/W_{sin}$ is 100% or less, where using a ring test piece having a magnetic path cross-sectional area of 70 $mm^2$ and having wound thereon a wiring with a primary winding number of 120 turns and a secondary winding number of 100 turns, iron loss $W_{inv}$ is measured when performing excitation by pulse width modulation control using an inverter at a maximum magnetic flux density of 1.5 T, a fundamental frequency of 50 Hz, a carrier frequency of 1 kHz, and a modulation factor of 0.4, and iron loss $W_{sin}$ is measured when performing excitation at a maximum magnetic flux density of 1.5 T and with sinusoidal alternating current at a frequency of 50 Hz.

8. The non-oriented electrical steel sheet of claim 1, wherein a rate of increase in iron loss $W_{inc}$ % calculated as $100(W_{inv}-W_{sin})/W_{sin}$ is 100% or less, where using a ring test piece having a magnetic path cross-sectional area of 70 $mm^2$ and having wound thereon a wiring with a primary winding number of 120 turns and a secondary winding number of 100 turns, iron loss $W_{inv}$ is measured when performing excitation by pulse width modulation control using an inverter at a maximum magnetic flux density of 1.5 T, a fundamental frequency of 50 Hz, a carrier frequency of 1 kHz, and a modulation factor of 0.4, and iron loss $W_{sin}$ is measured when performing excitation at a maximum magnetic flux density of 1.5 T and with sinusoidal alternating current at a frequency of 50 Hz.

9. A method for manufacturing the non-oriented electrical steel sheet of claim 1, the method comprising:

preparing a steel slab comprising a chemical composition containing, in mass %,

C: 0.005% or less,

Si: 4.5% or less,

Mn: 0.02% to 2.0%,

Sol.Al: 2.0% or less,

P: 0.2% or less,

Ti: 0.007% or less,

S: 0.005% or less, one or both of As and Pb: total of 0.0005% to 0.005%, and the balance consisting of Fe and inevitable impurities;

hot rolling the steel slab into a hot rolled sheet;

subjecting the hot rolled sheet to hot band annealing comprising a first soaking treatment performed with a soaking temperature of 800° C. to 1100° C. and a soaking time of 5 s or more and 5 min or less and a second soaking treatment performed with a soaking temperature of 1150° C. to 1200° C. and a soaking time of 1 s or more and 5 s or less;

subjecting the hot rolled sheet after the hot band annealing to cold rolling once or cold rolling twice or more with intermediate annealing in between to obtain a steel sheet with a final sheet thickness of 0.35 mm or less; and subjecting the steel sheet after the cold rolling to final annealing;

wherein a heating rate from 400° C. to 740° C. during the final annealing is 30° C./s to 300° C./s.

10. The method of claim 9, wherein the chemical composition further contains, in mass %, one or more of REM: 0.0005% to 0.005%, Mg: 0.0005% to 0.005%, and Ca: 0.0005% to 0.005%.

11. The method of claim 9, wherein the chemical composition further contains, in mass %, one or both of Sn: 0.01% to 0.2% and Sb: 0.01% to 0.2%.

12. The method of claim 11, wherein the chemical composition further contains, in mass %, one or more of REM: 0.0005% to 0.005%, Mg: 0.0005% to 0.005%, and Ca: 0.0005% to 0.005%.

* * * * *